US006170363B1

(12) United States Patent
Hu

(10) Patent No.: US 6,170,363 B1
(45) Date of Patent: Jan. 9, 2001

(54) NUT HOLDING DEVICES

(76) Inventor: Bobby Hu, 8F, No. 536-1, Ta Chin Street, Taichung (TW)

( * ) Notice: Under 35 U.S.C. 154(b), the term of this patent shall be extended for 0 days.

(21) Appl. No.: 09/335,391

(22) Filed: Jun. 17, 1999

(51) Int. Cl.[7] ..... B25B 13/02
(52) U.S. Cl. ..... 81/125; 81/438
(58) Field of Search ..... 81/125, 438, 452, 81/180.1, 177.85

(56) References Cited

U.S. PATENT DOCUMENTS 4,787,278 * 11/1988 Bononi ..... 81/438
5,724,872 * 3/1998 Shih ..... 81/125

* cited by examiner

*Primary Examiner*—David A. Scherbel
*Assistant Examiner*—Daniel Shanley
(74) *Attorney, Agent, or Firm*—Alan Kamrath

(57) ABSTRACT

A nut holding device is mounted in a socket of the type including a compartment defined by a polygonal inner periphery. The nut holding device includes a body mounted in the compartment, elastic plates formed on an upper side of the body for holding a nut to be loosened, a positioning arrangement formed on the body to position the body in the compartment, and resilient plates for biasing the nut to a level partially beyond the ratcheting tool. The positioning arrangement includes a number of legs extended downward from an underside of the body. Each leg includes a column section that engages with an associated angular section of the polygonal inner periphery of the ratcheting tool when the nut holding device is received in the compartment of the ratcheting tool.

20 Claims, 12 Drawing Sheets

B-B

C-C

B-B

A-A

B-B

NUT HOLDING DEVICES

BACKGROUND OF THE INVENTION

1. Field of the Invention

The present invention relates to nut holding devices that are mounted to a ratcheting tool for holding a nut after loosening.

2. Description of the Related Art

A conventional socket of, e.g., a ratchet wrench cannot hold a nut received therein. More specifically, the nut will be left on the site after it has been loosened. Manual removal of the nut is required and inadvertent loss of the nut often occurs. This problem is aggravated when the nut is disposed in a deep hole.

FIGS. 23 and 24 of the drawings illustrate a conventional nut holding member 24' received in a socket 20'. The inner periphery of the socket 20' includes two longitudinal grooves 221' and an annular groove 222' adjacent to an open end of the socket 20'. The nut holding member 24' is substantially U-shaped having two limbs 241' received in the longitudinal grooves 221 , respectively. One of the limbs 241' includes two arcuate portions 242' for retaining a nut 25' (FIG. 25). A distal end of the nut holding member 24' includes a retainer element 244' received in the annular groove 222' for retaining the nut 25' in the socket 20'. Nevertheless, the holding effect of the nut holding member 24' is found unsatisfactory since the nut 25' is held at only two sides thereof by two limbs 241' (FIG. 25). Thus, the nut 25' still tends to fall from the socket 20'. In addition, the U-shaped configuration of the nut holding member 24' is apt to deform as a result of expansion and thus might be disengaged from the longitudinal grooves 221'. As a result, positioning of the nut holding member 24' only relies upon the retainer element 244' in the annular groove 222' and thus is unreliable. This adversely affects the holding effect. If the holding force is designed to be relatively large for holding the nut, removal of the nut will be a problem after loosening of the nut. In actual use, the nut might be stuck deeply inside the socket such that the user has to remove the nut by tweezers or the like. Furthermore, it is difficult to machine the longitudinal grooves 221' and the annular groove 222' in the inner periphery of the socket 20', especially for those sockets 20' having an inner diameter smaller than 10 mm. A further drawback is that the nut holding member 24' cannot be applied to the currently available sockets without provision of the grooves 221' and 222'. Therefore, a set of sockets containing all sizes must be manufactured so as to form the grooves 221' and 222'. This results in an additional cost to the manufacturers and the users.

Applicant's U.S. patent application Ser. No. 09/293,034 filed on Apr. 16, 1999 proposes nut holding devices to solve the above problems.

The present invention is intended to provide nut holding devices that may eject the nut after the nut is disengaged from the bolt.

SUMMARY OF THE INVENTION

In accordance with a first aspect of the invention, a nut holding device is provided to be mounted in a ratcheting tool (e.g., a socket) of the type including a compartment defined by a polygonal inner periphery, the nut holding device comprising:

a body adapted to be mounted in the compartment, the body including an upper side;

a holding means formed on the upper side of the body for holding a nut to be loosened;

a positioning means formed on the body to position the body in the compartment; and means for biasing the nut to a level partially beyond the ratcheting tool.

The holding means includes a plurality of spaced elastic plates extended upward and inward from an outer periphery of the body. Each elastic plate includes a distal upper end that extends outward for guiding the nut into a holding space defined by the elastic plates. The distal end of each elastic plate extends to a level flush with an end face of the ratcheting tool. Each elastic plate includes a holding section from which the distal end of the elastic plate extends outward.

The polygonal inner periphery of the ratcheting tool includes a plurality of angular sections, and the positioning means includes a plurality of legs extended downward from an underside of the body. Each leg includes a column section that engages with an associated angular section of the polygonal inner periphery of the ratcheting tool when the nut holding device is received in the compartment of the ratcheting tool.

In accordance with a second aspect of the invention, there is provided a combination of a nut holding device and a ratcheting tool (e.g., a socket) of the type including a compartment defined by a polygonal inner periphery for receiving the nut holding device. The polygonal inner periphery of the ratcheting tool includes two opposing faces each having an arcuate groove defined therein. The nut holding device comprises:

a body mounted in the compartment, the body including an upper side;

two diametrically disposed elastic plates extended upwardly and inwardly from the upper side of the holding means formed on the upper side of the body for holding a nut to be loosened, each said elastic plate being received in an associated said arcuate groove when the body is received in the compartment of the ratcheting tool;

a positioning means formed on the body to position the body in the compartment; and means for biasing the nut to a level partially beyond the ratcheting tool.

The nut holding devices in accordance with the present invention may reliably hold a nut, and removal of the nut after loosening is easy. In addition, the nut to be loosened can be guided into the socket. Furthermore, the nut holding devices can be directly applied to currently available sockets.

Other objects, advantages, and novel features of the invention will become more apparent from the following detailed description when taken in conjunction with the accompanying drawings.

DETAILED DESCRIPTION OF THE PREFERRED EMBODIMENTS

Figure 2:
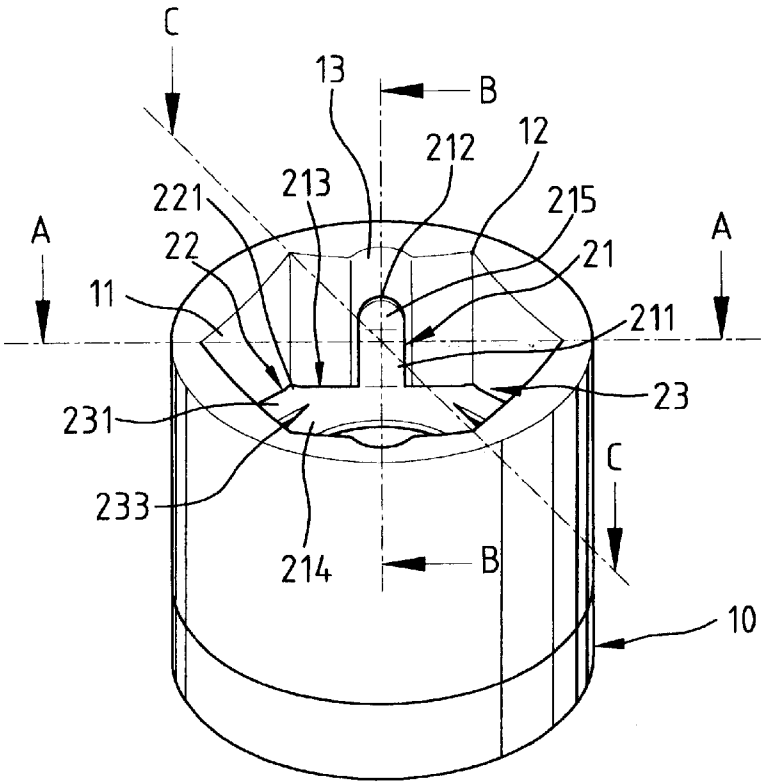
FIG. 2 is a perspective view of the socket with the first embodiment of the nut holding device received therein.
Figure 1:
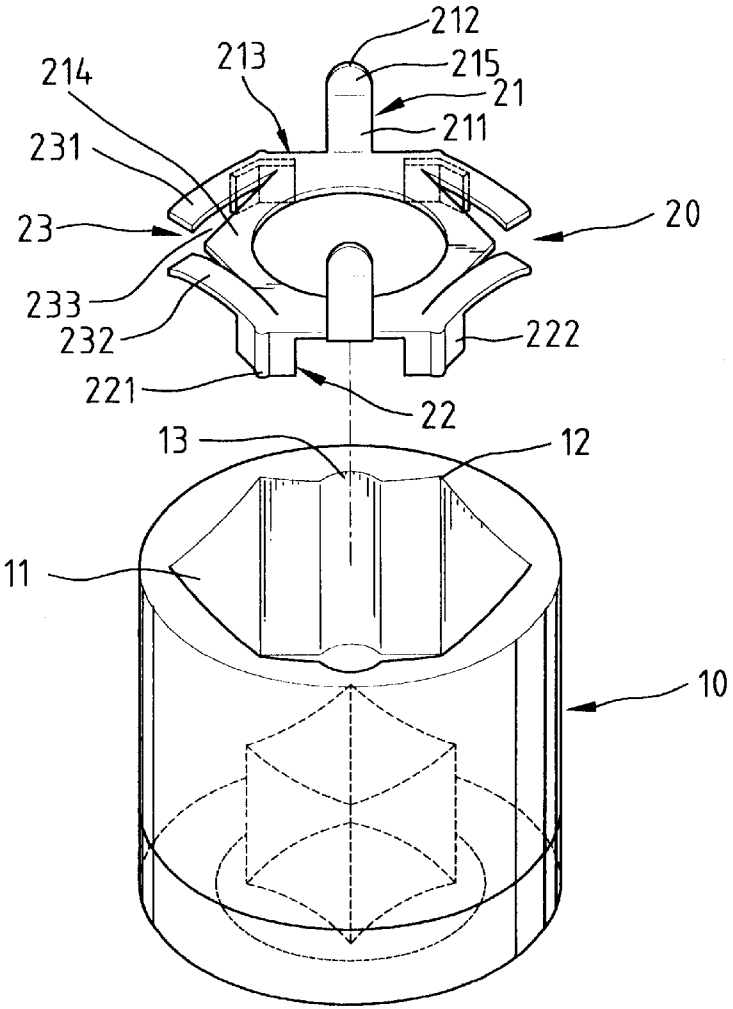
FIG. 1 is an exploded perspective view of a socket and a first embodiment of a nut holding device in accordance with the present invention.

Referring to the drawings and initially to FIGS. 1 and 2, a first embodiment of a nut holding device in accordance with the present invention is designated by "20" and adapted to be received in a ratcheting tool 10 (e.g., a socket) of the type having a compartment 11 defined by a polygonal inner periphery 12. In this embodiment, the polygonal inner periphery 12 consists of six faces in which two opposing faces thereof each have an arcuate groove 13 defined therein.

Figure 5:
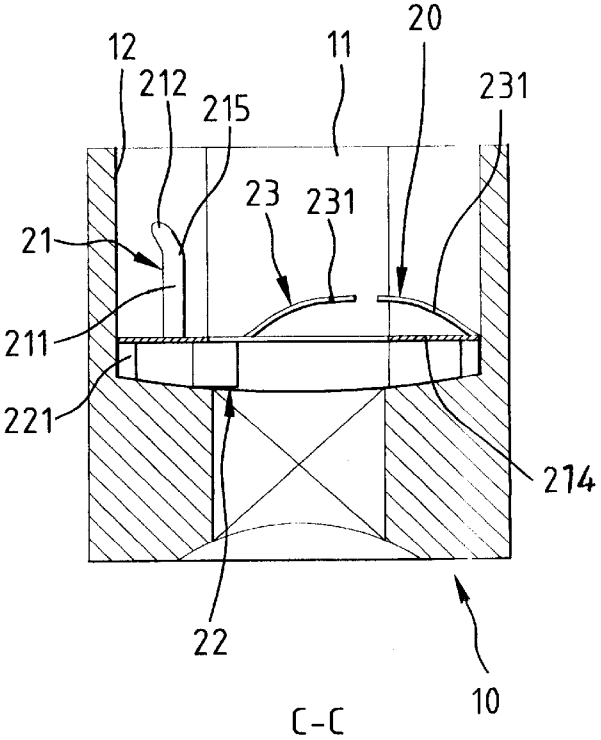
FIG. 5 is a sectional view taken along line C—C in FIG. 2.
Figure 4:
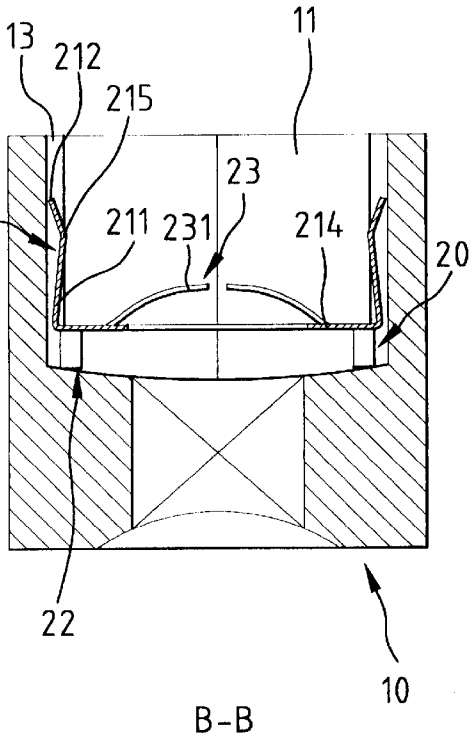
FIG. 4 is a sectional view taken along line B—B in FIG. 2.
Figure 3:
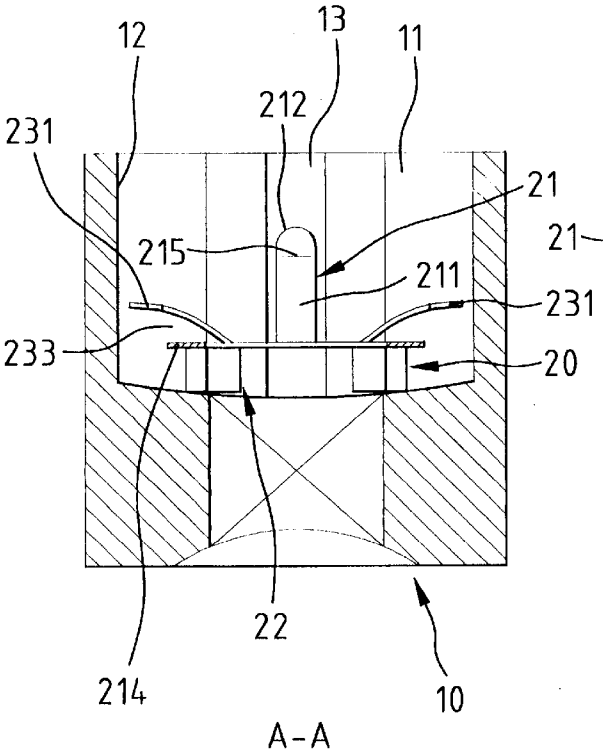
FIG. 3 is a sectional view taken along line A—A in FIG. 2.
Figure 9:
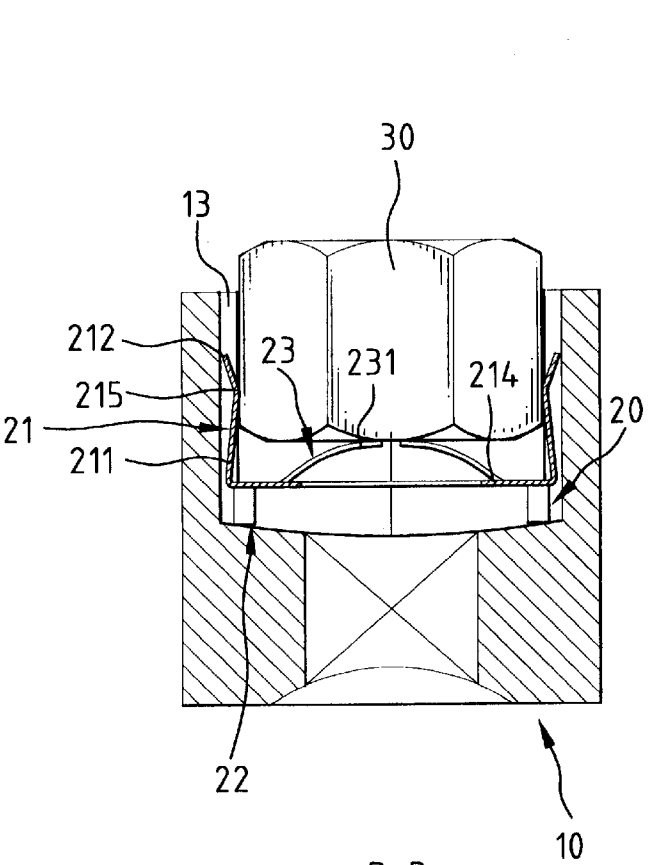
FIG. 9 is a cross sectional view similar to FIG. 4, wherein a nut is received in the socket.

The nut holding device 20 includes a substantially ring-like body 214 with a holding means 21 for holding a nut 30 (FIG. 9). In this embodiment, the holding means 21 includes two diametrically disposed elastic plates 211 extended upwardly from an outer periphery of the ring-like body 214. Each elastic plate 211 inclines inwardly and includes a distal upper end 212 that extends outwardly, thereby defining a holding section 215 (FIG. 4) for holding the nut 30. The upper ends 212 of the elastic plates 211 guide the nut 30 into a holding space 213 defined by the elastic plates 211. A positioning means 22 is provided to an underside of the ring-like body 214. The positioning means 22 includes a number of annularly spaced legs 222 each having a column section 221 for engaging with a corresponding angular section of the polygonal inner periphery 12 of the socket 10, thereby preventing disengagement of the nut holding device 20 from the socket 10. An additional function of the legs 222 is to elevate the ring-like body 214 (FIGS. 3 through 5). A nut-elevating means 23 is provided to an upper side of the ring-like body 214 for supporting the nut 30 such that the nut 30 held in the holding space 213 is partially beyond an end face of the socket 10, thereby allowing easy removal of the nut 30 from the nut holding device 20 (FIG. 9). In this embodiment, as can be seen from FIGS. 1, 3, 4, and 5, the nut-elevating means 23 includes two upwardly extending resilient plates 231 and 232 formed on two sides of the ring-like body 214 and having a space 23 therebetween. A slit 233 is defined between each resilient plate 231, 232 and the ring-like body 214 to provide the required resiliency for the resilient plates 231, 232. Thus, as can be seen from FIG. 9, the nut 30 held in the holding space 213 is partially beyond the end face of the socket 10, thereby allowing easy removal of the nut 30 from the nut holding device 20 after loosening of the nut 30.

Referring to FIG. 2, when the nut holding device 20 is mounted in the compartment 11 of the socket 10, each column 221 of the positioning means 22 is engaged with an associated angular section of the polygonal inner periphery 12 of the socket 10. In addition, each elastic plate 211 is received in an associated groove 13 of the polygonal inner periphery 12 of the socket 10.

Figure 7:
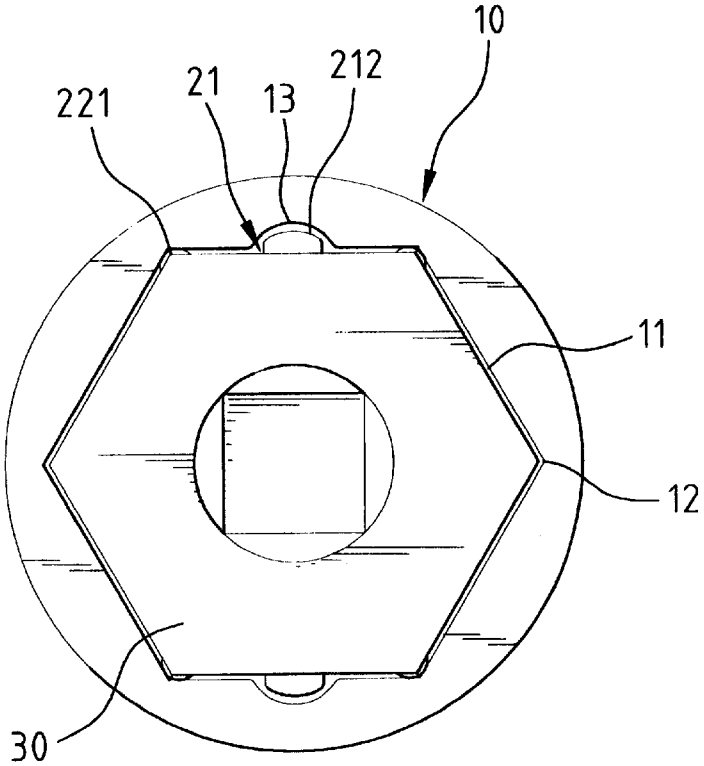
FIG. 7 is a top view similar to FIG. 6, wherein a nut is received in the socket.
Figure 6:
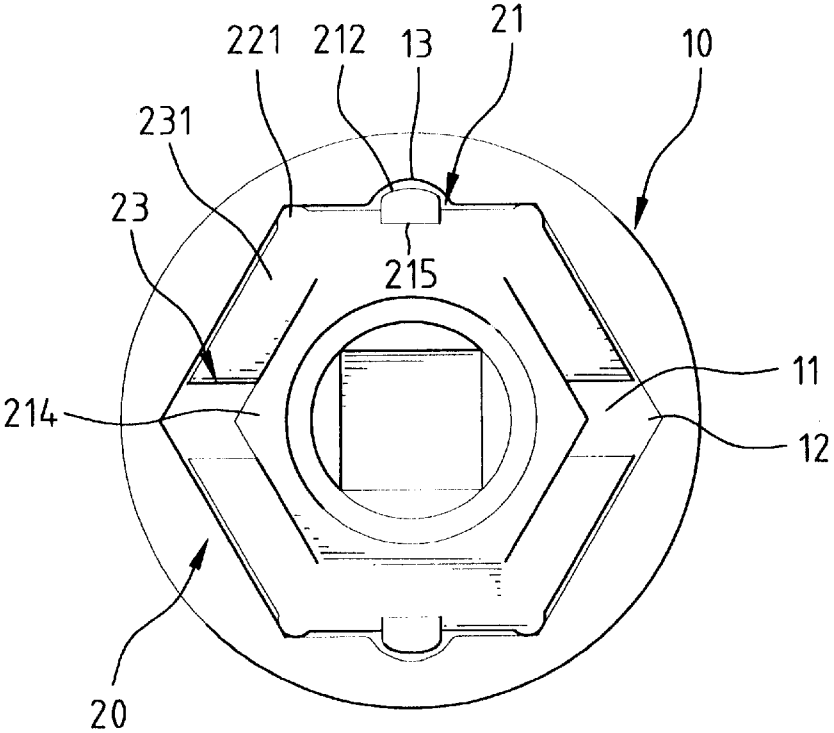
FIG. 6 is a top view of the socket in FIG. 2.
Figure 8:
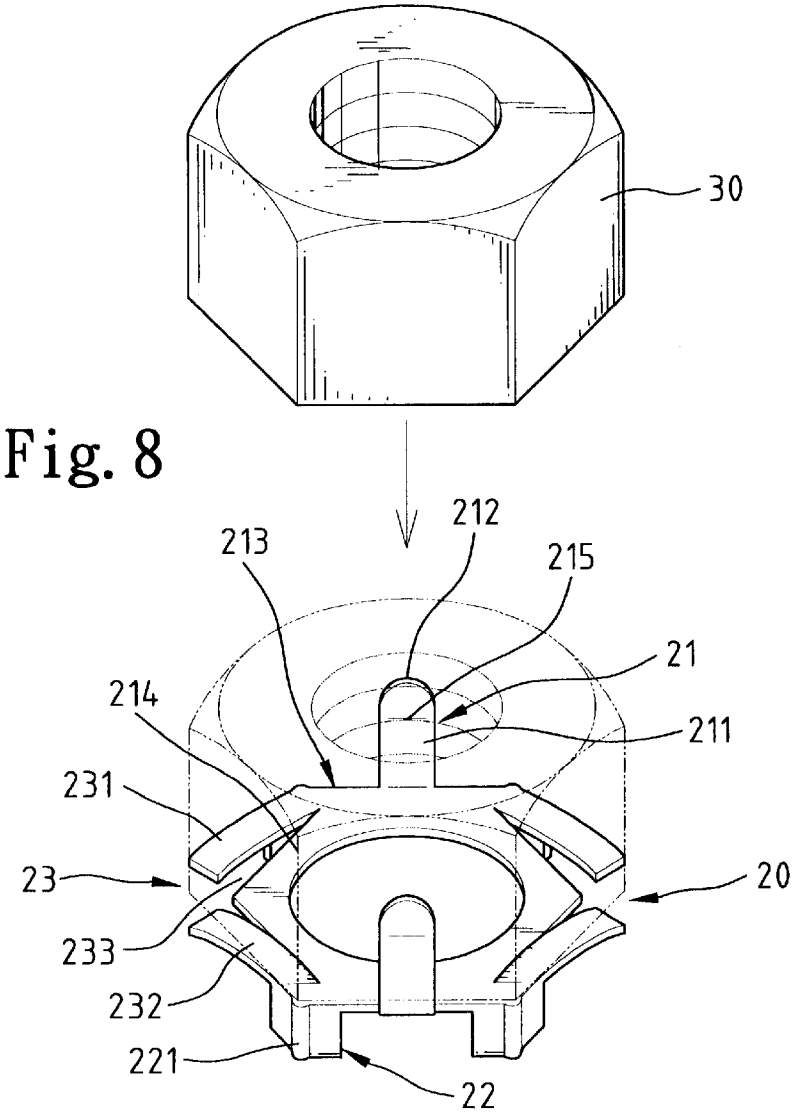
FIG. 8 is an exploded perspective view illustrating engagement of a nut and the first embodiment of the nut holding device in accordance with the present invention.

FIG. 6 is a top view of the socket 10 with the nut holding device 20 received therein. When a nut 30 is received in the nut holding device 20, as shown in FIG. 7, two faces of the nut 30 are securely held by the elastic plates 211 and the holding sections 215 of the nut holding device 20. FIG. 8 is a schematic perspective view illustrating engagement between the nut 30 and the nut holding device 20. The holding effect provided by the elastic plates 211 and the holding sections 215 is reliable without adversely affecting the wrenching operation of the nut 30, best shown in FIG. 9. In addition, the nut 30 is partially beyond the socket 10 by about one-fourth (¼) of the height of the nut 30, thereby allowing easy removal of the nut 30 after loosening of the nut 30.

Figure 11:
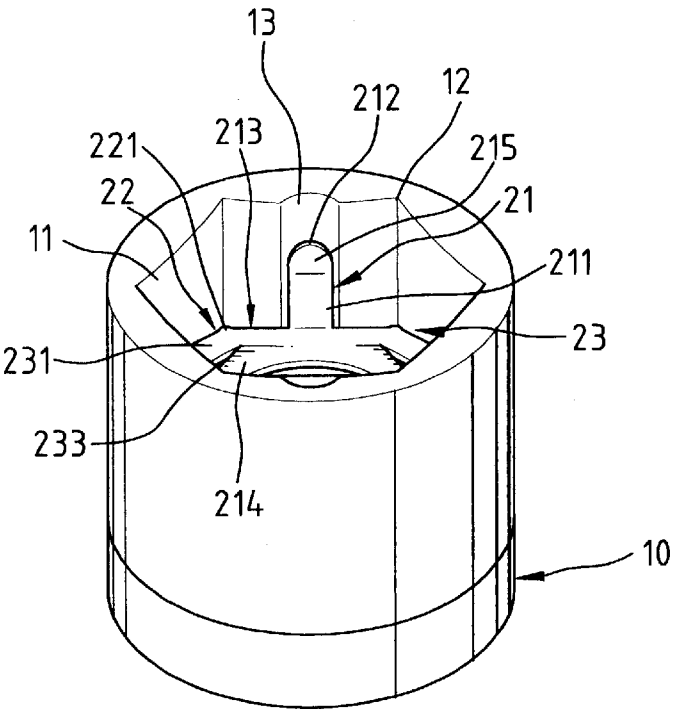
FIG. 11 is a perspective view of the socket with the second embodiment of the nut holding device received therein.
Figure 10:
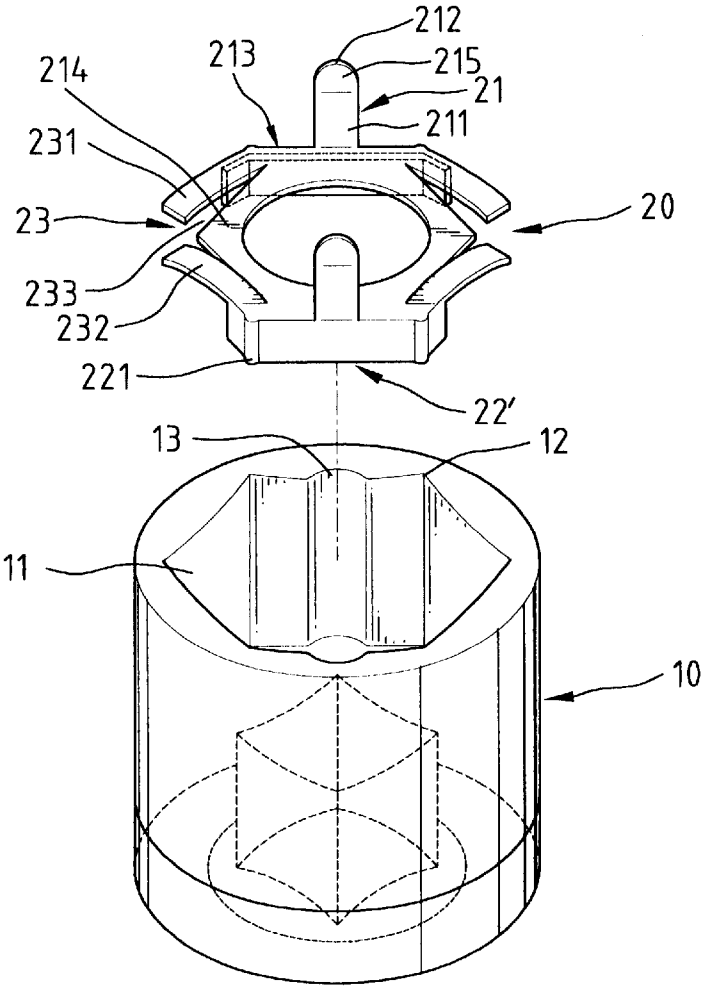
FIG. 10 is an exploded perspective view of a socket and a second embodiment of the nut holding device in accordance with the present invention.
Figure 13:
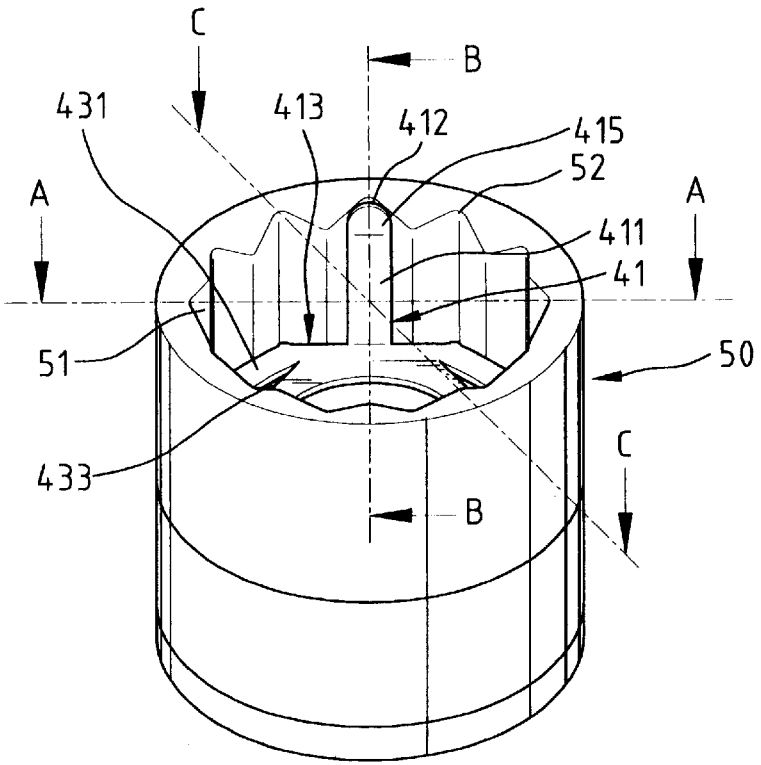
FIG. 13 is a perspective view of the socket with the third embodiment of the nut holding device received therein.

FIGS. 10 and 11 illustrates a second embodiment of a nut holding device 20 in accordance with the present invention, wherein only the positioning means (now designated by 22') is modified. Each two legs in the first embodiment are integrally formed to provide a stable structure for supporting the nut 30.

FIGS. 12 through 20 illustrates a modified application of the nut holding device in accordance with the present invention. The only difference between the nut holding device of the first embodiment (FIG. 1) and the nut holding device 40 of this third embodiment (FIG. 12) is the height of the elastic plates 411 and 211. In addition, reference numerals used in the third embodiment are led by "4" instead of "2". The elastic plate 411 has a height flush with the end face of the socket (now designated by 50) that has a twelve-faced inner periphery 52 defining a compartment 51 therein. The socket 50 is an ordinary socket without any modification. Other arrangement and function of the nut holding device 40 are identical to those of the nut holding device 20 and therefore not described to avoid redundancy. In this embodiment, referring to FIGS. 19 and 20, when a nut 30 is inserted into the socket 50, the nut 30 is guided by the elastic plates 411 in a smooth manner. More specifically, the user often has to try more than one times to fit the nut into a conventional socket yet with the nut holding device 40 in the socket 50, the nut 30 can be smoothly guided into the holding space 413 of the nut holding device 40 regardless of orientation of the nut 30 relative to the socket 50.

Figure 21:
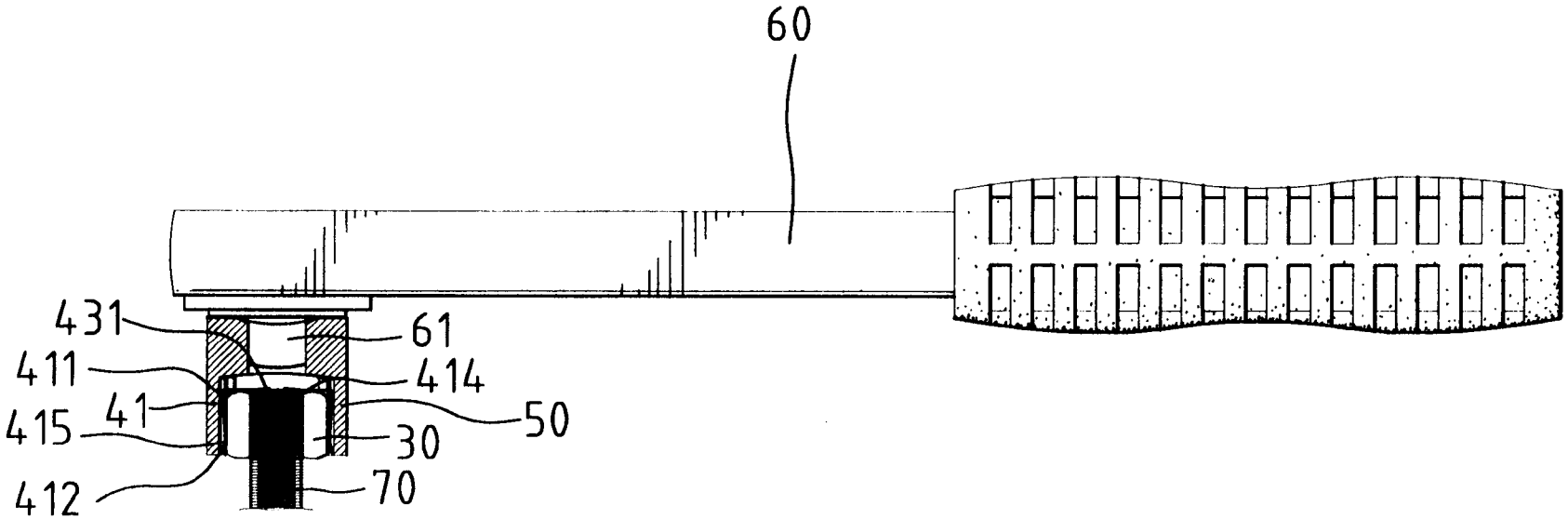
FIG. 21 is a side view illustrating application of the nut holding device to a ratchet wrench for loosening a nut from a bolt.
Figure 22:
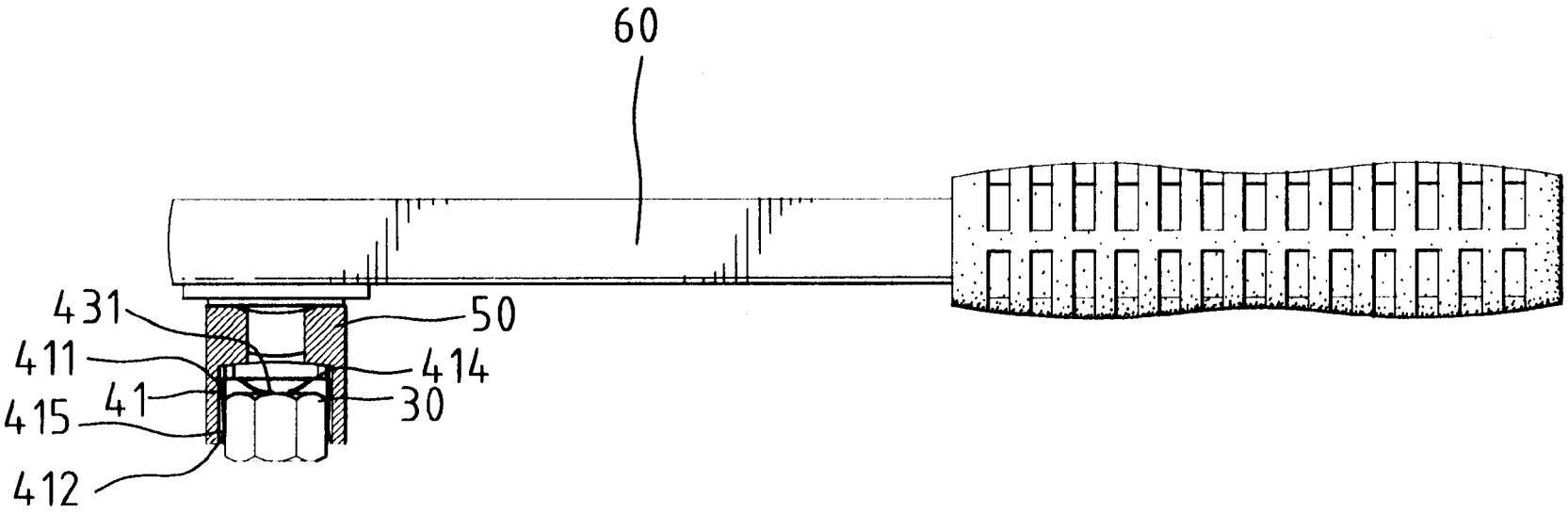
FIG. 22 is a side view similar to FIG. 21, wherein the nut has been disengaged from the bolt after unfastening.
Figure 23:
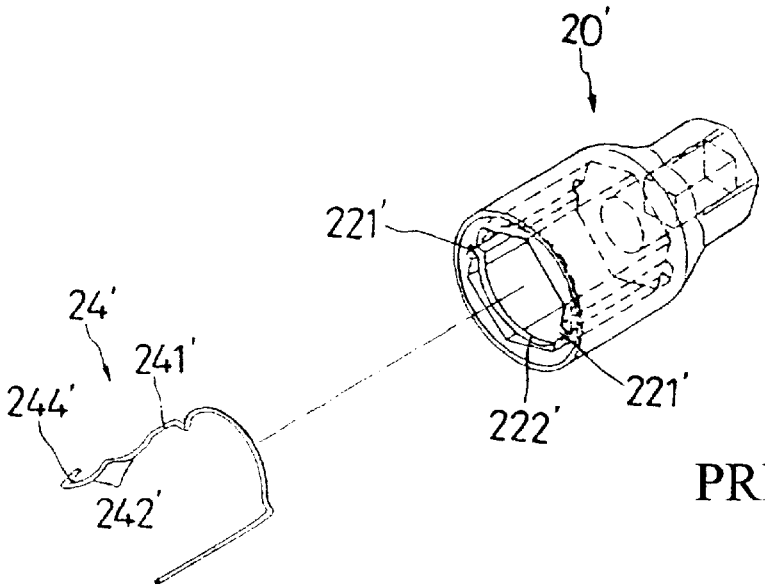
Fig. 23 PRIOR ART
FIG. 23 is an exploded perspective view of a socket and a conventional nut holding device.
Figure 24:
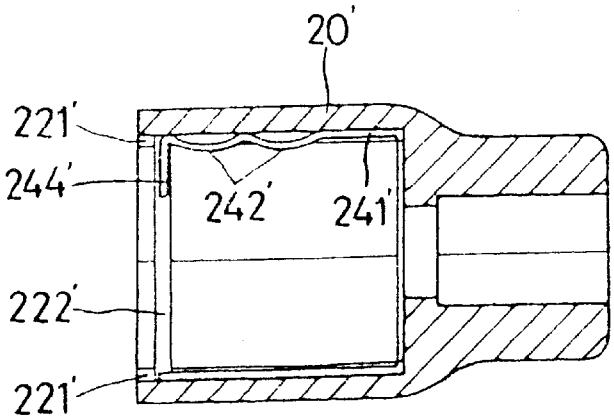
Fig. 24 PRIOR ART
FIG. 24 is a sectional view of the socket with the conventional nut holding device therein.
Figure 25:
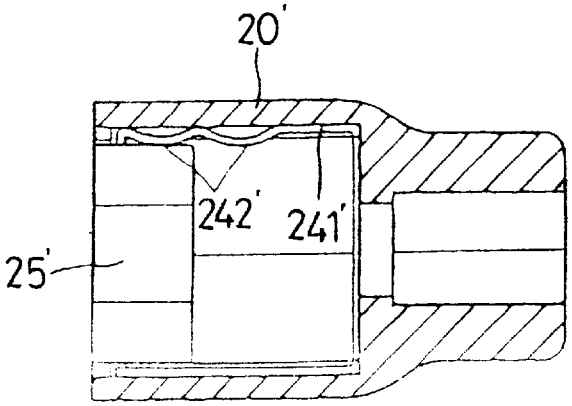
Fig. 25 PRIOR ART
FIG. 25 is a view similar to FIG. 23, wherein a nut is received in the socket.

FIGS. 21 and 22 illustrate operation of the nut holding device 40 applied to a ratchet wrench 60 with an engaging member 61 for engaging with a socket 50 having the nut holding device 40 therein. When operating the ratchet wrench 60, in addition to a torque for rotating the socket 50, the user applies a downward force that causes the nut 30 to be in close contact with a bottom of the holding space 413, and the resilient plates 431 and 432 (only 431 can be seen) are moved inwardly. After the nut 30 is completely disengaged from the bolt 70, the resilient plates 431 and 432 return to their original positions and thus move the nut 30 to a level partially beyond the socket 50 for easy manual removal of the nut 30 from the socket 50, as mentioned above. Alternatively, the user may swing the socket 50 to cause the nut 30 to fall from the socket 50 without the aid of any tool.

Figure 12:
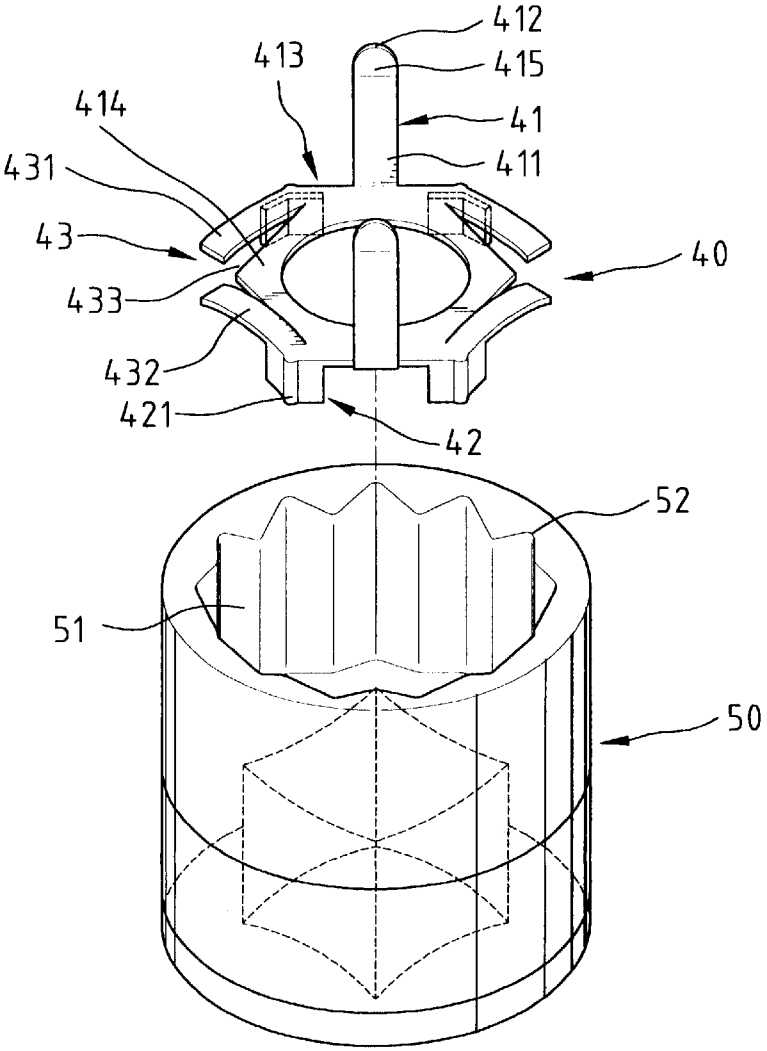
FIG. 12 is an exploded perspective view of a socket and a third embodiment of the nut holding device in accordance with the present invention.
Figure 16:
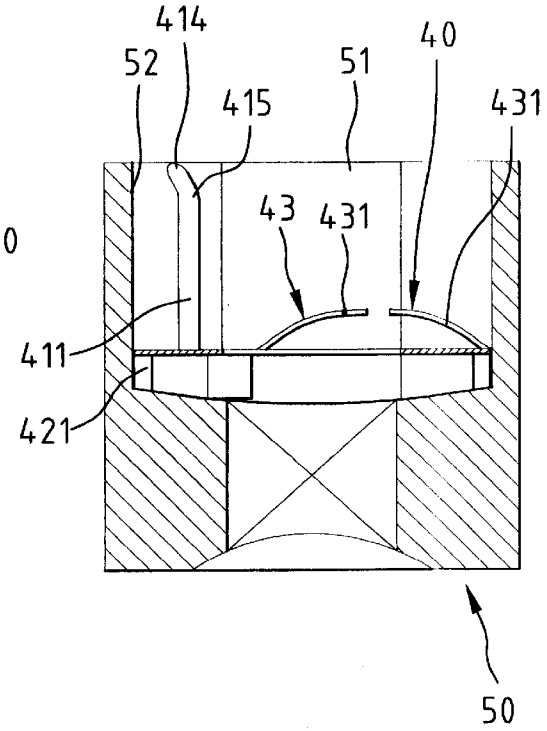
FIG. 16 is a sectional view taken along line C—C in FIG. 13.
Figure 15:
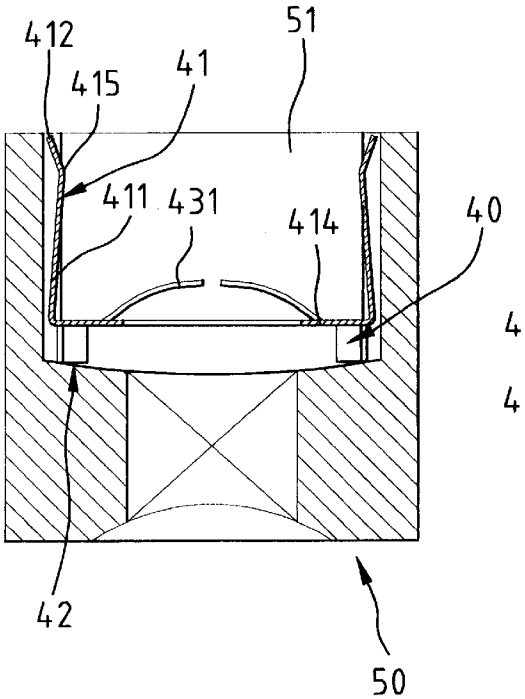
FIG. 15 is a sectional view taken along line B—B in FIG. 13.
Figure 14:
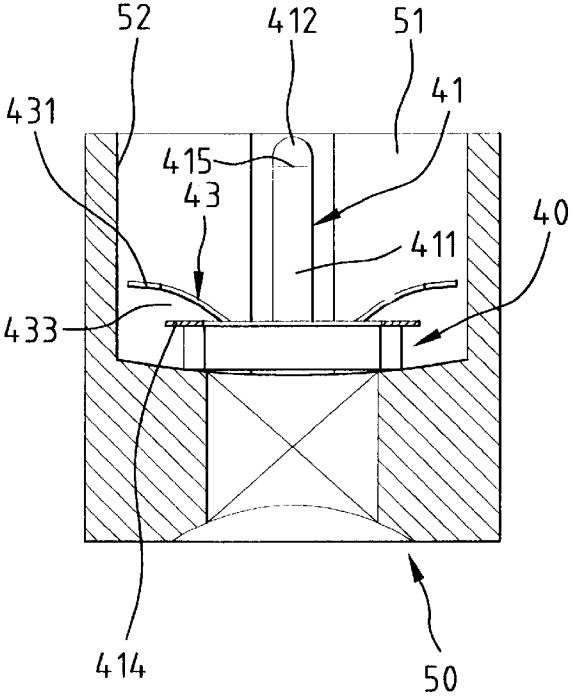
FIG. 14 is a sectional view taken along line A—A in FIG. 13.
Figure 18:
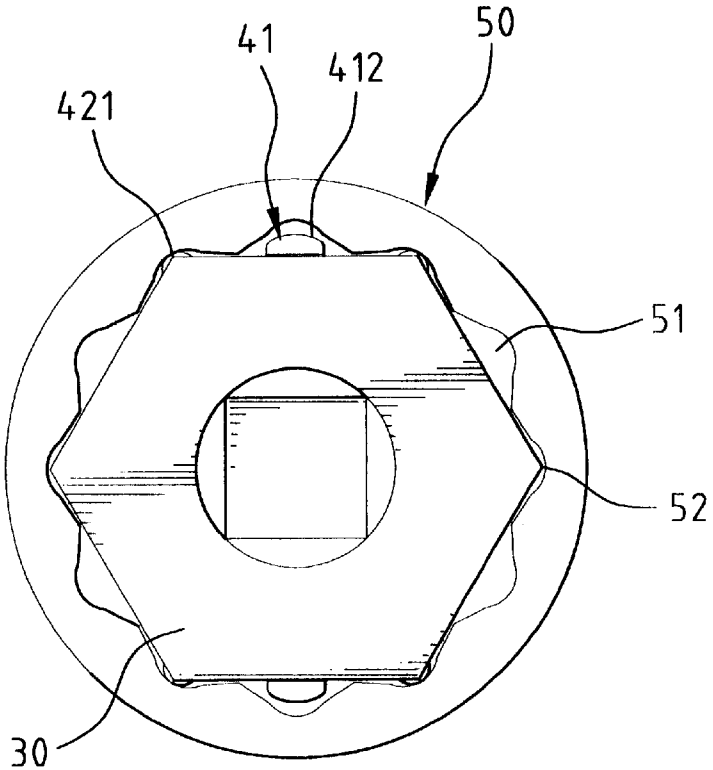
FIG. 18 is a top view similar to FIG. 17, wherein a nut is received in the socket.
Figure 17:
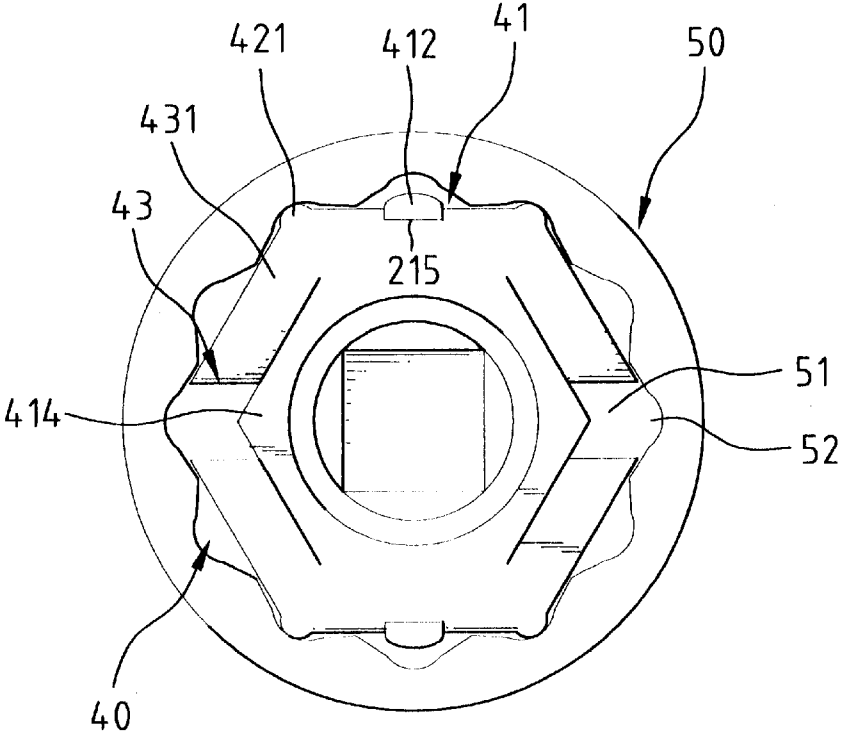
FIG. 17 is a top view of the socket in FIG. 13.
Figure 20:
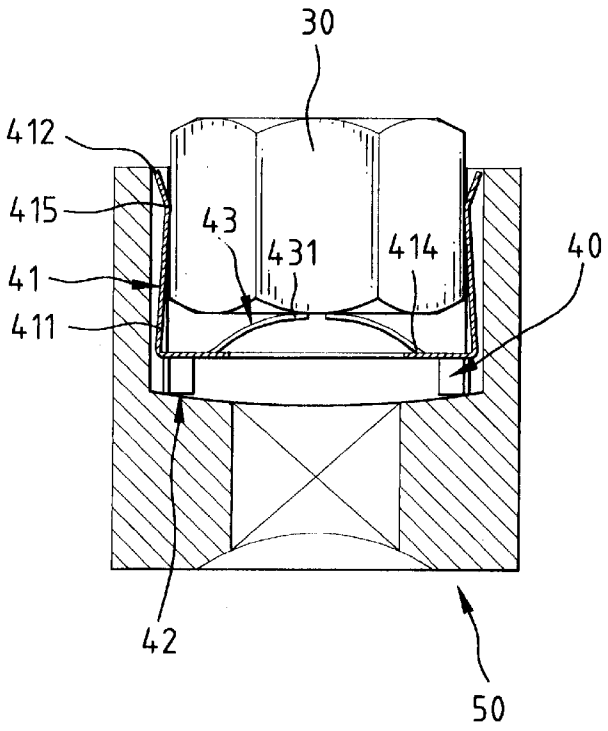
FIG. 20 is a cross sectional view similar to FIG. 15, wherein a nut is received in the socket.
Figure 19:
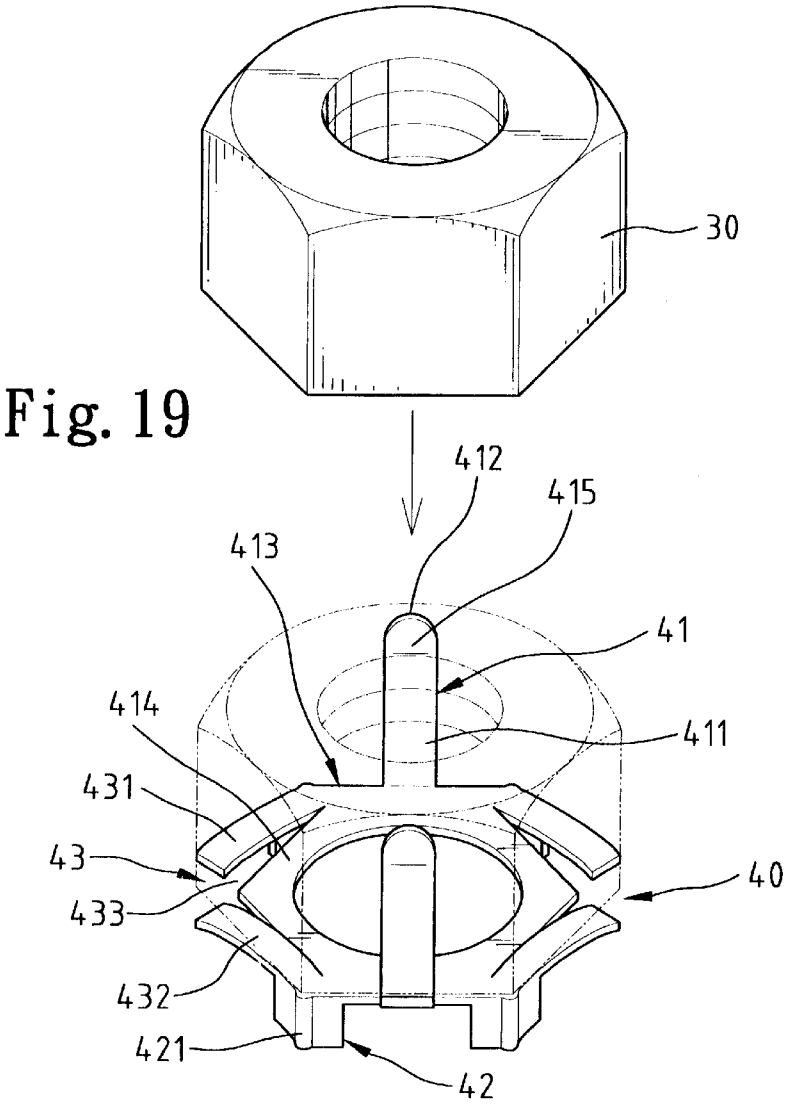
FIG. 19 is an exploded perspective view illustrating engagement of a nut and the third embodiment of the nut holding device in accordance with the present invention.

According to the above description, it is appreciated that the nut holding devices of the present invention may reliably hold a nut, and removal of the nut after loosening is easy. In addition, the nut to be loosened can be guided into the socket. Furthermore, the nut holding devices can be directly applied to currently available sockets (FIG. 12).

Although the invention has been explained in relation to its preferred embodiment, it is to be understood that many other possible modifications and variations can be made without departing from the spirit and scope of the invention as hereinafter claimed.

What is claimed is:

1. A nut holding device adapted to be mounted in a ratcheting tool of the type including a compartment defined by a polygonal inner periphery, the nut holding device comprising:

a body adapted to be mounted in the compartment, the body including an upper side;

a holding means formed on the upper side of the body for holding a nut to be loosened;

a positioning means formed on the body to position the body in the compartment; and means for elevating the nut within the holding means to a level partially beyond compartment of the ratcheting tool.

2. The nut holding device as claimed in claim 1, wherein the body includes an outer periphery, and the holding means includes a plurality of spaced elastic plates extended upward and inward from the outer periphery of the body.

3. The nut holding device as claimed in claim 2, wherein each said elastic plate includes a distal upper end that extends outward for guiding the nut into a holding space defined by the elastic plates.

4. The nut holding device as claimed in claim 3, wherein the distal end of each said elastic plate extends to a level flush with an end face of the ratcheting tool.

5. The nut holding device as claimed in claim 3, wherein each said elastic plate includes a holding section from which the distal end of the elastic plate extends outward.

6. The nut holding device as claimed in claim 1, wherein the polygonal inner periphery of the ratcheting tool includes a plurality of angular sections, and wherein the positioning means includes a plurality of legs extended downward from an underside of the body, each said leg including a column section that is adapted to be engaged with an associated said angular section of the polygonal inner periphery of the ratcheting tool when the nut holding device is received in the compartment of the ratcheting tool.

7. A combination of a nut holding device and a ratcheting tool of the type including a compartment defined by a polygonal inner periphery for receiving the nut holding device, the polygonal inner periphery of the ratcheting tool including two opposing faces each having an arcuate groove defined therein, the nut holding device comprising:

a body mounted in the compartment, the body including an upper side;

two diametrically disposed elastic plates extended upwardly and inwardly from the upper side of the body for holding a nut to be loosened, each said elastic plate being received in an associated said arcuate groove when the body is received in the compartment of the ratcheting tool;

a positioning means formed on the body to position the body in the compartment; and means for elevating the nut within the holding means to a level partially beyond compartment of the ratcheting tool.

8. The combination as claimed in claim 7, wherein each said elastic plate includes a distal upper end that extends outward for guiding the nut into a holding space defined by the elastic plates.

9. The combination as claimed in claim 8, wherein the distal end of each said elastic plate extends to a level flush with an end face of the ratcheting tool.

10. The combination as claimed in claim 8, wherein each said elastic plate includes a holding section from which the distal end of the elastic plate extends outward.

11. The combination as claimed in claim 7, wherein the polygonal inner periphery of the ratcheting tool includes a plurality of angular sections, and wherein the positioning means includes a plurality of legs extended downward from an underside of the body, each said leg including a column section that engages with an associated said angular section of the polygonal inner periphery of the ratcheting tool when the body is received in the compartment of the ratcheting tool.

12. The combination as claimed in claim 7, wherein the ratcheting tool is a socket.

13. The combination as claimed in claim 11 wherein each leg includes first and second column sections that engage circumferentially adjacent angular sections of the polygonal inner periphery of the ratcheting tool when the body is received in the compartment of the ratcheting tool.

14. The combination as claimed in claim 7 wherein the biasing means comprises a first resilient plate extending upwardly from the body and which contacts the nut held by the elastic plates.

15. The combination as claimed in claim 14 wherein the biasing means further comprises a second resilient plate, with the first and second resilient plates being formed on two sides of the body.

16. The nut holding device as claimed in claim 2 wherein the biasing means comprises a first resilient plate extending upwardly from the body and which contacts the nut held by the elastic plates.

17. The nut holding device as claimed in claim 16 wherein the plurality of spaced elastic plates comprises first and second elastic plates diametrically disposed on the body; and wherein the first resilient plate is circumferentially spaced from the first and second elastic plates.

18. The nut holding device of claim 17 wherein the biasing means further comprises, in combination: a second resilient plate extending upwardly from the body and which contacts the nut held by the elastic plates, with the second resilient plate being circumferentially spaced from the first and second elastic plates and the first resilient plate.

19. The nut holding device of claim 1 wherein the biasing means comprises a first resilient plate extending upwardly from the body and which contacts the nut held by the holding means.

20. The nut holding device as claimed in claim 6 wherein each leg includes first and second column sections that engage circumferentially adjacent angular sections of the polygonal inner periphery of the ratcheting tool when the nut holding device is received in the compartment of the ratcheting tool.

* * * * *